US007205723B2

(12) United States Patent
Kurachi et al.

(10) Patent No.: US 7,205,723 B2
(45) Date of Patent: Apr. 17, 2007

(54) ELECTRODELESS DISCHARGE LAMP

(75) Inventors: Toshiaki Kurachi, Hirakata (JP); Satoshi Kominami, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/286,428

(22) Filed: Nov. 25, 2005

(65) Prior Publication Data

US 2006/0071584 A1 Apr. 6, 2006

Related U.S. Application Data

(63) Continuation of application No. PCT/JP2005/001405, filed on Feb. 1, 2005.

(30) Foreign Application Priority Data

Feb. 5, 2004 (JP) ..... 2004-029072

(51) Int. Cl.
*H01J 17/20* (2006.01)
*H01J 61/04* (2006.01)

(52) U.S. Cl. ..... 313/631; 313/571

(58) Field of Classification Search ..... 315/56, 315/326; 313/483–484, 489, 491, 493, 561–562, 313/559, 563, 565–567, 571, 631, 634, 6, 313/637, 639, 643
See application file for complete search history.

(56) References Cited

U.S. PATENT DOCUMENTS 4,704,562 A 11/1987 Postma et al. ..... 315/248
5,291,091 A 3/1994 Eggink et al. ..... 313/161
5,696,426 A * 12/1997 Antonis et al. ..... 313/485
5,798,618 A * 8/1998 van Os et al. ..... 315/248
5,811,914 A * 9/1998 Eijkens ..... 313/51
5,814,951 A * 9/1998 Smolka et al. ..... 315/326
5,903,109 A 5/1999 Van Gennip et al. ..... 315/248
6,051,922 A * 4/2000 Schlejen et al. ..... 313/489
6,057,649 A * 5/2000 Van Der Zaag et al. .... 315/248
6,084,359 A 7/2000 Hetzel et al. ..... 315/248
2002/0067129 A1 6/2002 Chamberlin et al. ..... 313/607
2004/0140706 A1 7/2004 Harrison ..... 297/440.1

FOREIGN PATENT DOCUMENTS

EP 0 135 960 4/1985
EP 0 496 464 7/1992

(Continued)

*Primary Examiner*—Shih-Chao Chen
*Assistant Examiner*—Minh Dieu A
(74) *Attorney, Agent, or Firm*—Wenderoth, Lind & Ponack, L.L.P.

(57) ABSTRACT

An electrodeless discharge lamp has a magnetic core 3, an induction coil 5, and a fixation member 7. The fixation member 7 has an elongation portion 7*b* extending in a direction along an axial line of the magnetic core 3, a holding portion 7*c* for holding the magnetic core 3 positioned closer to the magnetic core 3 than the elongation portion 7*b*, and hook portions 7*d* and 7*e* to which a winding wire 7 is hooked so as to be inflected. The hook portions 7*d* and 7*e* positioned away from a boundary between the holding portion 7*c* and magnetic core 3 toward the elongation portion 7*b* by a distance between once and twice of a diameter of the winding wire.

15 Claims, 14 Drawing Sheets

FOREIGN PATENT DOCUMENTS

| | | |
|---|---|---|
| EP | 0 817 241 | 1/1998 |
| EP | 1 050 897 | 11/2000 |
| JP | 60-72155 | 4/1985 |
| JP | 10-92391 | 4/1988 |
| JP | 4-308648 | 10/1992 |
| JP | 11-508406 | 7/1999 |
| JP | 2003-346734 | 12/2003 |
| JP | 2004-220918 | 8/2004 |
| WO | 97/40518 | 10/1997 |

* cited by examiner

ELECTRODELESS DISCHARGE LAMP

This is a continuation application of International Application No. PCT/JP2005/001405, filed Feb. 1, 2005.

BACKGROUND OF THE INVENTION

The present invention relates to an electrodeless discharge lamp for emitting light by an electromagnetic field generated by an induction coil disposed in a re-entrant portion or cavity of a bulb.

In recent years, from the viewpoint of protecting global environment, discharge lamps having higher efficiency and longer life in comparison with incandescent lamps have been used widely. Further, research and commercialization of electrodeless discharge lamps having remarkably longer life in comparison with conventional discharge lamps having electrodes in a discharge space are being carried out earnestly. Not having the electrodes in the discharge space case the limited life of the conventional discharge lamps, the electrodeless discharge lamps have significantly extended life. For this reason, diffusion of the electrodeless discharge lamps in the future is expected.

In this kind of electrodeless discharge lamp, a discharge plasma is generated in the discharge space by a high-frequency electromagnetic field generated by an induction coil arranged in a cavity of a bulb, resulting in that the lamp emits light. The induction coil is formed of a winding wire wound around a magnetic core made of a magnetic material and has the shape of a solenoid of a finite length. Generally, a ferrite material is used widely for the magnetic core. The lamp is driven by a high-frequency power having a frequency of several tens of kHz to several tens of MHz and supplied to the winding wire.

Japanese Patent Application Laid-Open 60-72155 discloses a structure of a typical induction coil shown in FIG. 14. An electrodeless low-pressure mercury vapor discharge lamp shown in FIG. 14 has a discharge vessel or bulb 101 made of glass and filled with mercury and krypton. An induction coil 103 and a magnetic core 104 are accommodated in a tubular cavity 102 of the bulb 101. A cross-sectional area of the magnetic core 104 is in the range of 20 to 60 $mm^2$. The induction coil 103 is formed of a winding wire 105 directly wound 10 to 15 turns around the magnetic core 104.

Japanese Patent Application Laid-Open 10-92391 discloses two structures respectively shown in FIGS. 15 and 16. One structure shown in FIG. 15 is a type of that a winding wire of an induction coil is directly wound around a magnetic core. The other structure shown in FIG. 16 is a type of that a bobbin is provided between a magnetic core and an induction coil. In the structure shown in FIG. 15, a pair of fingers 202 is integrated with a base 201 for supporting a bulb (not shown). These fingers 202 extend so as to pass through a cylindrical magnetic core 204 around which an induction coil 203 is wound. The fingers 202 have protruding portions 202*a* for supporting the magnetic core 204 at one ends opposite to the base 201. The magnetic core 204 is supported by a spring washer 205 so as not to wobble. In the structure shown in FIG. 16, an induction coil 303 is wound around a coil bobbin 302 integrated with a base 301 for supporting a bulb. A magnetic core 304 is held in a groove formed in the inner circumferential face of the coil bobbin 302.

However, the above-mentioned conventional electrodeless discharge lamps have problems described below.

In the case of magnetic core made of a material having relatively low electric conductivity, such as Ni—Zn ferrite, the probability of dielectric breakdown is low even when no particular consideration is given to the insulation between the magnetic core and the winding wire. However, in the case that a driving frequency of a drive circuit is between 50 kHz and 1 MHz, there is a possibility that a material having relatively high electric conductivity, such as Mn—Zn ferrite, Cu—Zn ferrite, silicon steel plate, or permalloy, is used for the magnetic core. When such a material having relatively high electric conductivity is used for the magnetic core, it is essential to secure high insulation reliability between the magnetic core and the winding wire.

However, induction coils of which the winding wires are directly wound around the magnetic core as shown if FIGS. 14 and 15 make it considerably difficult to secure insulation reliability. Specifically, at winding start and winding end portions of the winding wire, the winding wire is apt to be bent acutely or sharply. Even if the winding wire is covered with insulating coating, the acute or sharp bending of the winding wire is apt to cause not only uneven flatness or uneven thickness in the insulating coating but also damages of the insulating coating. As a result, the dielectric breakdown occurs easily between the magnetic core and the winding wire or between adjacent portions of winding wire.

Further, a number of turns of the induction coil tends to become larger as the driving frequency of the lamp is lower. While strength of an induced electric field in the bulb required for generating and maintaining the discharge plasma hardly changes with variation of the driving voltage, strength of an induced electric field due to magnetic fluxes generated by the induction coil is proposal to the driving frequency. For this reason, as the driving frequency is lower, it is necessary to increase the number of turns of the induction coil in order to increase the magnetic fluxes. More specifically, in the case that the driving frequency is low, it is necessary to increase the number of turns by reducing an interval between adjacent portions of the winding wire (winding pitch) or by winding the winding wire in multi-layer. Therefore, in case that the drive voltage is a relatively low value of 1 MHz or less, it is essential to secure insulation between the winding wires.

Wherein the coil bobbin 302 is provided between the magnetic core 304 and the induction coil 303 as shown in FIG. 16, it is possible to prevent the dielectric breakdown between the winding wire of the induction coil 303 and the magnetic core 304. However, an outside diameter of the induction coil 303 becomes larger due to a wall thickness of the coil bobbin 302. This results in that a size of the cavity of the bulb needs to be increased. The whole size of the bulb is limited by sizes of a lighting apparatuses being generally used. For this reason, as the cavity become larger, the discharge space inside the bulb eventually becomes smaller, causing increase of a diffusion loss of the discharge plasma which occurs a possibility that the luminous efficiency of the lamp is adversely affected.

SUMMARY OF THE INVENTION

An object of the present invention is to provide an electrodeless discharge lamp having a compact structure wherein a winding wire of an induction coil is directly wound around a magnetic core and a high reliability in insulations between the winding wire and magnetic core and between adjacent portions of the winding wires.

The present invention provides an electrodeless discharge lamp comprising a bulb filled inside with a discharge gas and having a cavity, a magnetic core disposed in the cavity, an induction coil formed by winding a winding wire with an electrically insulating coating around the magnetic core and disposed in the cavity, and a fixation member for fixing the magnetic core. The fixation member has an elongation portion extending in a direction along an axial line of the magnetic core, a holding portion for holding the magnetic core positioned closer to the magnetic core than the elongation portion, and a inflecting portion for inflecting the winding wire positioned away from a boundary between the holding portion and the magnetic core toward the elongation portion by a distance between once and twice of a diameter of the winding wire. The winding wire of the induction coil has a winding portion wound around the magnetic core via the coating, and straight portions extending toward the magnetic core along the elongation portion.

The inflecting portion is a hook portion or groove structure, for example.

It is preferable that the winding wire of the induction coil has a bent portion at the hook portion or groove structure.

The hook portion or groove structure (inflecting portion) is positioned away from the boundary between the holding portion and the magnetic core toward the elongation portion by a distance between once and twice of the winding wire. Thus, even in the case that the winding wire has the bent portion at the inflecting portion, the holding portion is disposed between the bent portion of the winding wire and the magnetic core. This prevents dielectric breakdown between the winding wire and the magnetic core. The length from the inflection portion to the tip of the holding portion is set at the minimum length required for prevention of the dielectric breakdown between the winding wire and the magnetic core, i.e., a length equal to or more than the diameter of the winding wire and not more than the double of the diameter. Therefore, unlike the case that a coil bobbin is provided, the outside dimensions (or example, the outside diameter) of the induction coil can be reduced, and the induction coil can have a compact configuration. As a result, the dimensions of the cavity can be reduced, and the discharge space of the bulb can be enlarged. The enlarged discharge space makes it easy to generate the plasma discharge by supplying relatively small power.

The driving frequency of a drive circuit for supplying high-frequency power to the induction coil is preferably between 50 kHz and 1 MHz. The losses of the drive circuit include switching losses in switching devices in addition to losses owing to the resistance components of respective circuit elements. By setting the driving frequency at 1 MHz or less, the switching losses can be reduced and power can be efficiently supplied to the discharge plasma inside the bulb.

In the case that the driving frequency of the drive circuit is set between 50 kHz and 1 MHz, the magnetic core is preferably made of a magnetic material of low loss and high magnetic permeability. The magnetic core is preferably made of Mn—Zn ferrite. Further, the magnetic core may also be made of other magnetic materials of low loss and high magnetic permeability at a frequency between 50 kHz and 1 MHz, such as Cu—Zn ferrite, silicon steel plate, and permalloy. Such magnetic materials of low loss and high magnetic permeability at the frequency between 50 kHz and 1 MHz, including Mn—Zn ferrite, generally have high conductivity. Thus, in the case that these magnetic materials are used for the magnetic core, the effect of improving the insulation reliability between the winding wire and the magnetic core in the present invention is particularly significant.

A number of the layers of the winding portion of the winding wire is preferably even number. In the case that the number of the layers of the winding portion is even number, both a winding start portion and winding end portion of the winding wire are positioned in the vicinity of the fixation member. Thus, any acute inflecting portion wherein the insulating coating becomes extremely thin is not required to be provided for the winding wire, resulting in that the insulation reliability is improved further.

The drive circuit has a first output terminal with a first output and a second output terminal with a second output lower than the first output. The winding portion of the winding wire is connected to the second output terminal (the low-voltage output terminal)of the drive circuit at an end of the winding start portion. The potential difference between the winding wire and the magnetic core can be reduced by connecting the winding start portion of the winding portion to the low-voltage second output terminal. As a result, the thickness of the insulating coating of the winding wire can be made smaller, thereby the outside dimensions (for example, the outside diameter) of the induction coil can be reduced.

In the case that the winding start portion of the winding portion is connected to the low-voltage second output terminal, for the purpose of securely preventing dielectric breakdown, the step formed by a contour of the holding portion and a contour of the magnetic core preferably has a size between 30% and 110% of a diameter of the winding wire The winding portion of the winding wire may also be connected to the second first output terminal (the high-voltage output terminal) of the drive circuit at the end of the winding start portion. In this case, for the purpose of securely preventing dielectric breakdown between the winding wire and the magnetic core, the step formed by the contours of the holding portion and magnetic core preferably has a size between 10% and 30% of a diameter of the coated winding wire.

The winding wire may further have a dummy winding portion at a side of the drive circuit with respect to the straight portion. By providing the dummy winding portion, the winding wire can be securely prevented from being detached from the magnetic core and the fixation member.

By providing a second inflecting portion for inflecting the dummy winding portion at the elongation portion of the fixation member, the winding wire can be further securely prevented from being detached from the magnetic core and the fixation member.

The electrodeless discharge lamp makes it possible to secure the insulation performance between the adjacent portions of winding wire of the induction coil and between the magnetic core and the winding wire, enabling to realize high reliability. Further, since the induction coil can be configured so as to be compact, the dimensions of the cavity can be reduced, and the discharge space of the bulb can be enlarge. Accordingly, the plasma discharge can be generated easily by supplying relatively small power.

BRIEF DESCRIPTION OF DRAWINGS

These and other objects and features of the invention will become apparent from the following description taken in conjunction with preferred embodiments of the invention with reference to the accompanying drawings, in which:

FIG. 10 is an enlarged partial perspective view of the electrodeless discharge lamp according to the second embodiment of the present invention;

DETAILED DESCRIPTION OF THE PREFERRED EMBODIMENT

Figure 1:
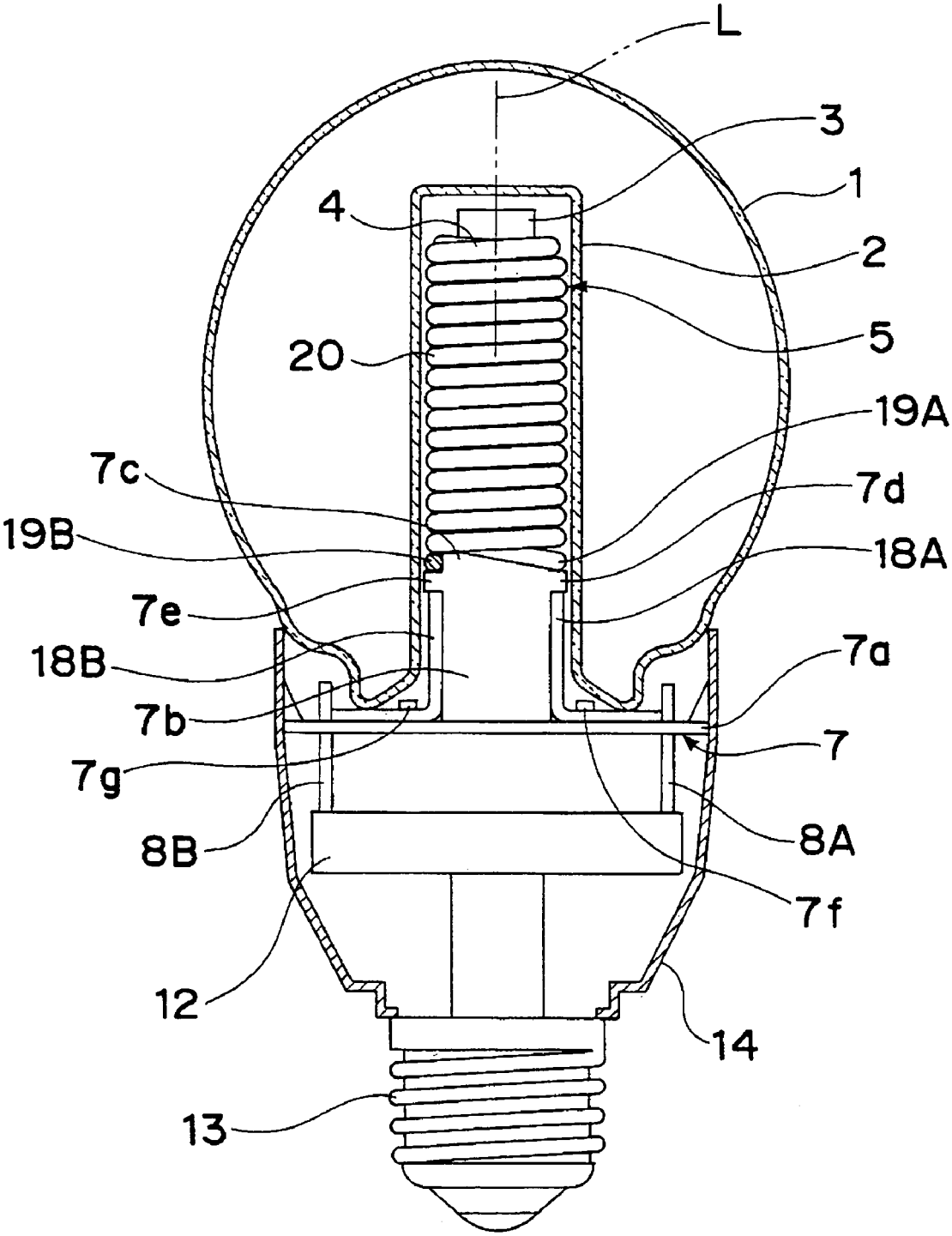
FIG. 1 is a partially sectional front view of an electrodeless discharge lamp according to a first embodiment of the present invention.

Embodiments of an electrodeless discharge lamp according to the present invention will be described below referring to attached drawings. In the drawings, for the sake of simplicity, components having substantially the same functions are designated by the same reference numerals. The present invention is not limited to embodiments described below.

First Embodiment

FIG. 1 shows an electrodeless discharge lamp in accordance with a first embodiment. A discharge vessel or a bulb 1 is made of a translucent material, such as soda glass, and inside thereof is hermetically sealed. The inside of the bulb 1, serving as a discharge space, is filled with a discharge gas. The discharge gas is a mixture of mercury vapor and various noble gases. However, the discharge gas is not limited to such mixture. For example, metal halides, sodium, and cadmium may also be used, and appropriate substances for obtaining a desired emission spectrum can be selectively used. In this embodiment, a mixture of mercury vapor and a krypton gas is sealed at 150 Pa within the bulb 1. An inner surface of the bulb 1 is coated with a fluorescent material.

The bulb 1 has a re-entrant portion or cavity 2. This cavity 2 is formed of a part of the translucent material of the bulb 1 and is a tubular portion protruding from a bottom portion to the inside of the bulb 1. An inside of the cavity is shut off from the inside of the bulb 1 and communicates with the outside air.

Inside the cavity 2 of the bulb 1, a magnetic core 3 having a nearly cylindrical shape and an induction coil 5 formed by winding a winding wire 4 multiple turns around the magnetic core 3 are accommodated.

Figure 6:
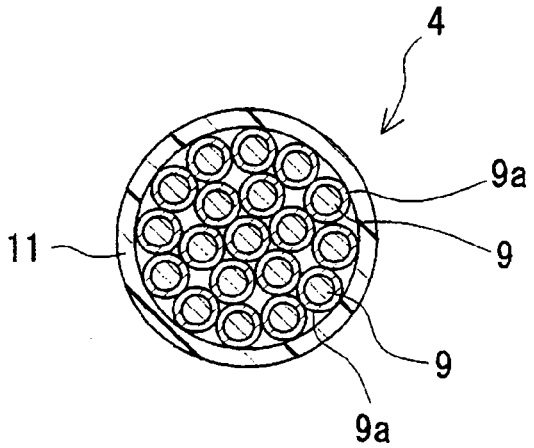
FIG. 6 is a schematic sectional view of a winding wire 4 according to the first embodiment of the present invention.

With reference to FIG. 6, the winding wire 4 is formed of a litz wire constructed of multiple thin wires 9 bundled together, each having a small diameter and coated with a thin insulating layer 9*a* having electrical insulation. An insulating coating 11 made of a resin is further provided on an outside of the bundled thin wires 9 to secure electrical insulation between the magnetic core 3 and the winding wire 4. The insulating coating 11 made of a resin is gradually degraded in dielectric breakdown voltage by heat from a high-temperature discharge plasma generated during lamp lighting. Thus, it is necessary to properly design the material and thickness of the insulating coating 11 in consideration of a temperature of the winding wire 4 during the lamp lighting and a high voltage generated in the induction coil 5 when the lamp lighting is started. As a material suited for the insulating coating 11, a material based on a fluorine resin (PFA) can be used, for example. The PFA serves as a resin coating material having excellent insulating resistance maintenance performance at high temperatures.

In this embodiment, the magnetic core 3 has a substantially cylindrical shape. However, the shape of the magnetic core 3 is not limited to such a cylindrical shape, but the shape may be other shapes, such as a cylindrical column shape and polygonal column shape. Further, the magnetic core 3 is fixed to a fixation member 7. The fixation member 7 is provided with a pair of terminals 8A and 8B. One end of each of the terminals 8A and 8B is connected to the winding wire 4 of the induction coil 5, and the other end thereof is connected to a drive circuit 12. The structure of the fixation member 7 will be detailed later.

The drive circuit 12 is connected to a base cap 13 for receiving power supplied from a commercial power source and covered with a case 14. Further, the case 14 holds the base plate portion 7*a* of the fixation member 7 described later. Furthermore, the case 14 is made of a material, such as PBT (polybutylene terephthalate).

The operation of the electrodeless discharge lamp of the present embodiment will be described below. The drive circuit 12 converts an electrical power supplied from the commercial power source via the base cap 13 into a high-frequency power having a frequency between 50 kHz and 1 MHz and supplies the high-frequency power to the induction coil 5. When the high-frequency power is supplied to the induction coil 5, a magnetic field is generated from the induction coil 5. An induced electric field is generated inside the bulb 1 by the magnetic field. The induced electric field generates a discharge plasma inside the bulb 1. Discharged substances, such as mercury, excited in the discharge plasma generate visible light or ultraviolet light, and the light is emitted to the outside through the outer surface of the bulb 1.

Then, a driving frequency of the drive circuit 12 will be described below. The losses of the drive circuit 12 include switching losses in switching devices (designated by numerals 36 and 37 in FIG. 8) in addition to losses owing to the resistance components of respective elements used in the drive circuit 12. It is generally known that the switching losses increase as the driving frequency is higher. In other words, as the driving frequency is higher, the power supplied to the bulb 1 (the discharge plasma) tends to become lower, and heat generation in the switching devices 36 and 37 increases. For the purpose of reducing the switching losses, it is preferable that the driving frequency of the drive circuit 12 is limited to not more than 1 MHz. Furthermore, if the driving frequency is less than 50 kHz, the induced electric field generated by the induction coil 5 becomes very weak. This makes it difficult to generate and maintain the discharge plasma. It is thus preferable that the driving frequency of the drive circuit 12 is equal to or more than 50 kHz. Because of these reasons, it is preferable that the driving frequency of the drive circuit 12 is set within a range between 50 kHz and 1 MHz.

Then, a material for the magnetic core 3 will be described below. In this embodiment, the magnetic core 3 is made of Mn—Zn ferrite. In the case that the lamp is driven at the driving frequency within the range between 5 kHz and 1 MHz, the Mn—Zn ferrite is most desirable as the material of the magnetic core 3 in view of its low loss and high magnetic permeability. However, without being limited to Mn—Zn ferrite, materials having high magnetic permeability and low loss at the driving frequency between 5 kHz and 1 MHz can be used to obtain effects of the present invention. Cu—Zn ferrite, silicon steel plate, permalloy, and like are available as materials having high magnetic permeability and low loss at the driving frequency between 5 kHz and 1 MHz. All of these magnetic core materials have electric conductivity.

Then, the detailed configurations of the magnetic core 3, induction coil 5, and fixation member 7 will be described below referring to FIGS. 2 to 4.

A proximal end side of the magnetic core 3 is secured or fixed to the fixation member 7. The configuration of its fixing mechanism will be described later in detail. The fixation member 7 is made of an insulating material. Further, the fixation member 7 is provided with the base plate portion 7*a* having a disc shape on which the terminals 8A and 8B are installed. An elongation portion 7*b* having a substantially cylindrical shape and extending in a direction along an axial line L of the magnetic core 3 is integrated with the base plate portion 7*a*. A proximal end side of the elongation portion 7*b* is connected to the base plate portion 7*a*. A holding portion 7*c* having a substantially cylindrical shape is provided at a position closer to the magnetic core 3 than the elongation portion 7*b* so as to continue the elongation portion 7*b*. The holding portion 7*c* has a function of holding (fixating) the magnetic core 3 and a function of providing electrical insulation between the winding wire 4 and the magnetic core 3. Further, provided at the boundary between the elongation portion 7*b* and the holding portion 7*c* are hooking projections (hook portions) 7*d* and 7*e*, exemplified as inflecting portions for inflecting the winding wire 4. The winding wire 4 is hooked at these hooking projections 7*d* and 7*e*. The hooking projections 7*d* and 7*e* protrude from the boundary between the elongation portion 7*b* and the holding portion 7*c* in a direction substantially perpendicular to the axial line L of the magnetic core 3. Furthermore, the pair of hooking projections 7*d* and 7*e* are symmetrically disposed each other with respect to the axial line L in a plane view.

Figure 3A:
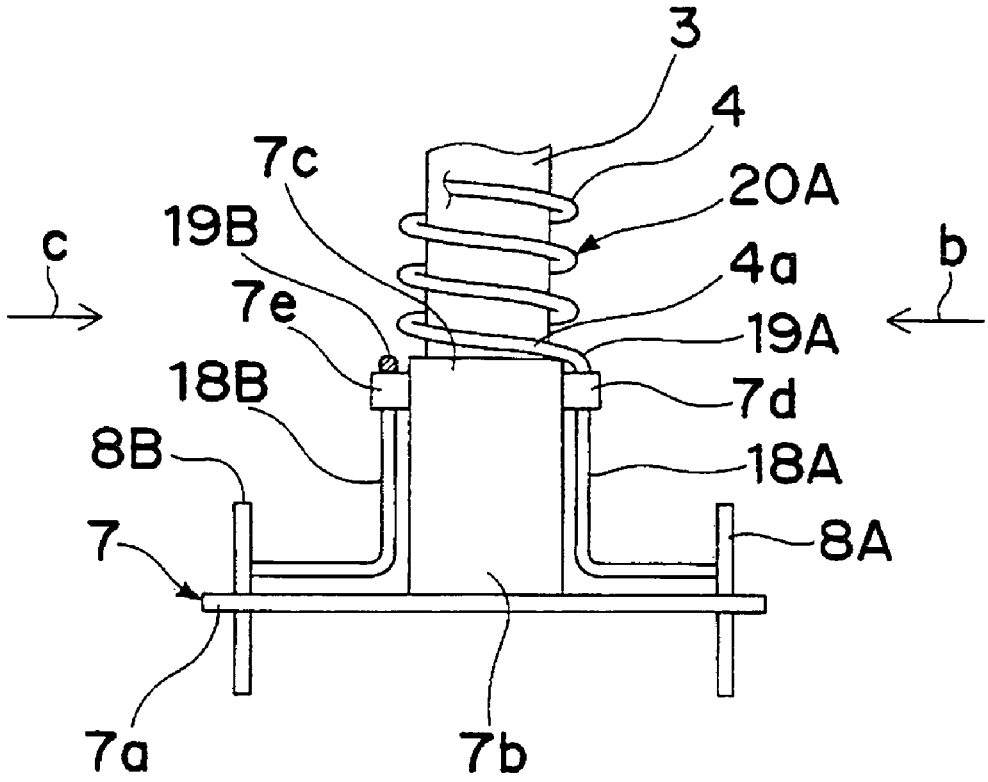
FIG. 3A is a schematic view of an induction coil 5, a magnetic core 3, and a fixation member 7 according to the first embodiment of the present invention.
Figure 3B:
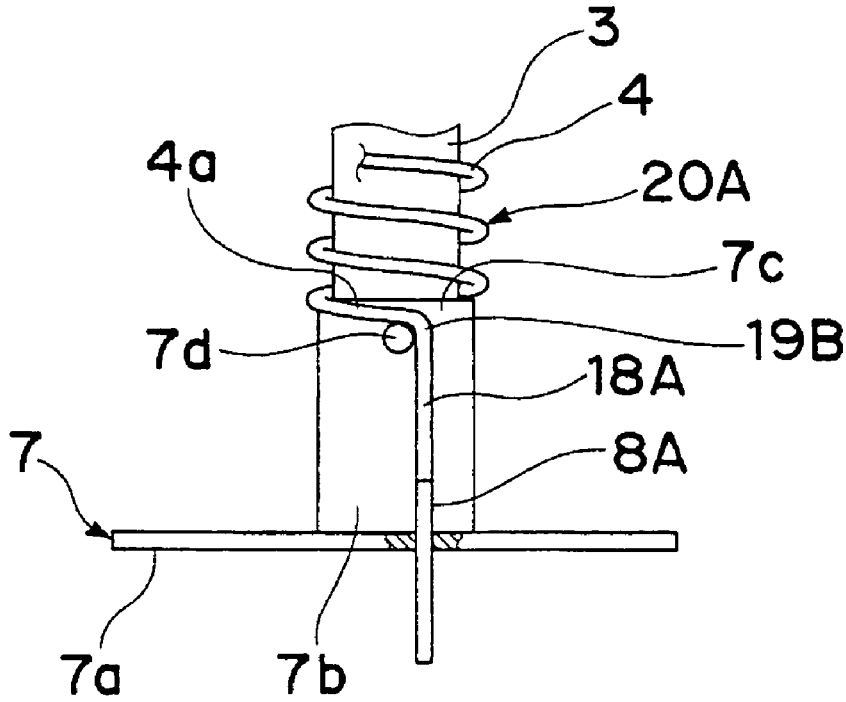
FIG. 3B is a schematic view of the induction coil 5, the magnetic core 3, and the fixation member 7 according to the first embodiment of the present invention, viewing in a direction of an arrow b in FIG. 3A.
Figure 3C:
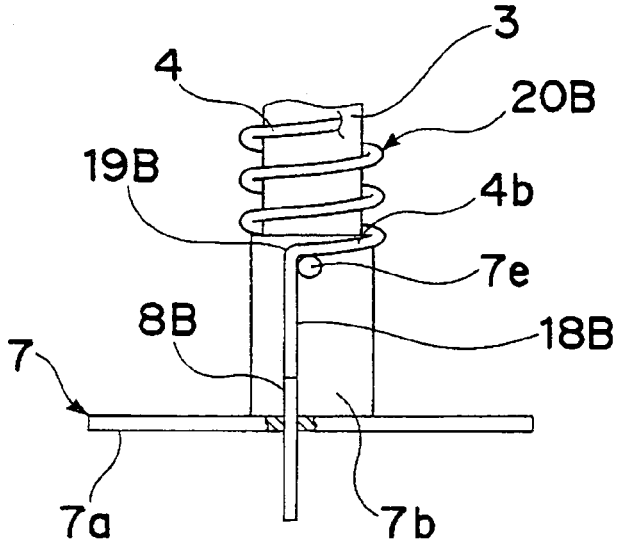
FIG. 3C is a schematic view of the induction coil 5, the magnetic core 3, and the fixation member 7 according to the first embodiment of the present invention, viewing in a direction of an arrow c in FIG. 3A.

FIGS. 3A to 3C show a method for winding the winding wire 4 according to the present embodiment. FIG. 3A is a view schematically showing the magnetic core 3, the induction coil 5 (the winding wire 4) and the fixation member 7, and shows only an end portion on the winding start side (winding start portion 4*a*) and the vicinity thereof, instead of the whole of the winding wire 4. In addition, FIG. 3B is a view taken in a direction of an arrow b in FIG. 3A. FIG. 3B also shows only the winding start portion 4*a* and the vicinity thereof. Further, FIG. 3C is a view taken in a direction of an arrow c in FIG. 3A. FIG. 3C shows only an end portion on the winding end side (winding end portion 4*b*) and the vicinity thereof, instead of the whole of the winding wire 4. Elements unnecessary for description are omitted as necessary.

Referring to FIGS. 2A, 3A and 3B, one end of the winding wire 4 having the insulating coating 11 is wound around the terminal 8A and fixed thereto by soldering. The winding wire 4 extends from the terminal 8A toward the elongation portion 7*b* along the base plate portion 7*a*. The winding wire 4 then passes through a hook 7*f* in the vicinity of the elongation portion 7*b*, further extends and is bent toward the magnetic core 3. The bent winding wire 4 extends toward the magnetic core 3 along the elongation portion 7*b* (to form a straight portion 18A). Furthermore, the winding wire 4 is hooked at the hooking projection 7*d* so as to be bent. Thus, an extension direction of the winding wire 4 is changed from the direction along the axial line L to the direction intersecting with the axial line L (to form a bent portion 19A). The winding wire 4 extending from the hooking projection 7*d* is directly wound around the magnetic core 3 in the shape of a solenoid so as to surround or enclose the magnetic core 3 (to form a winding portion 20).

Figure 2:
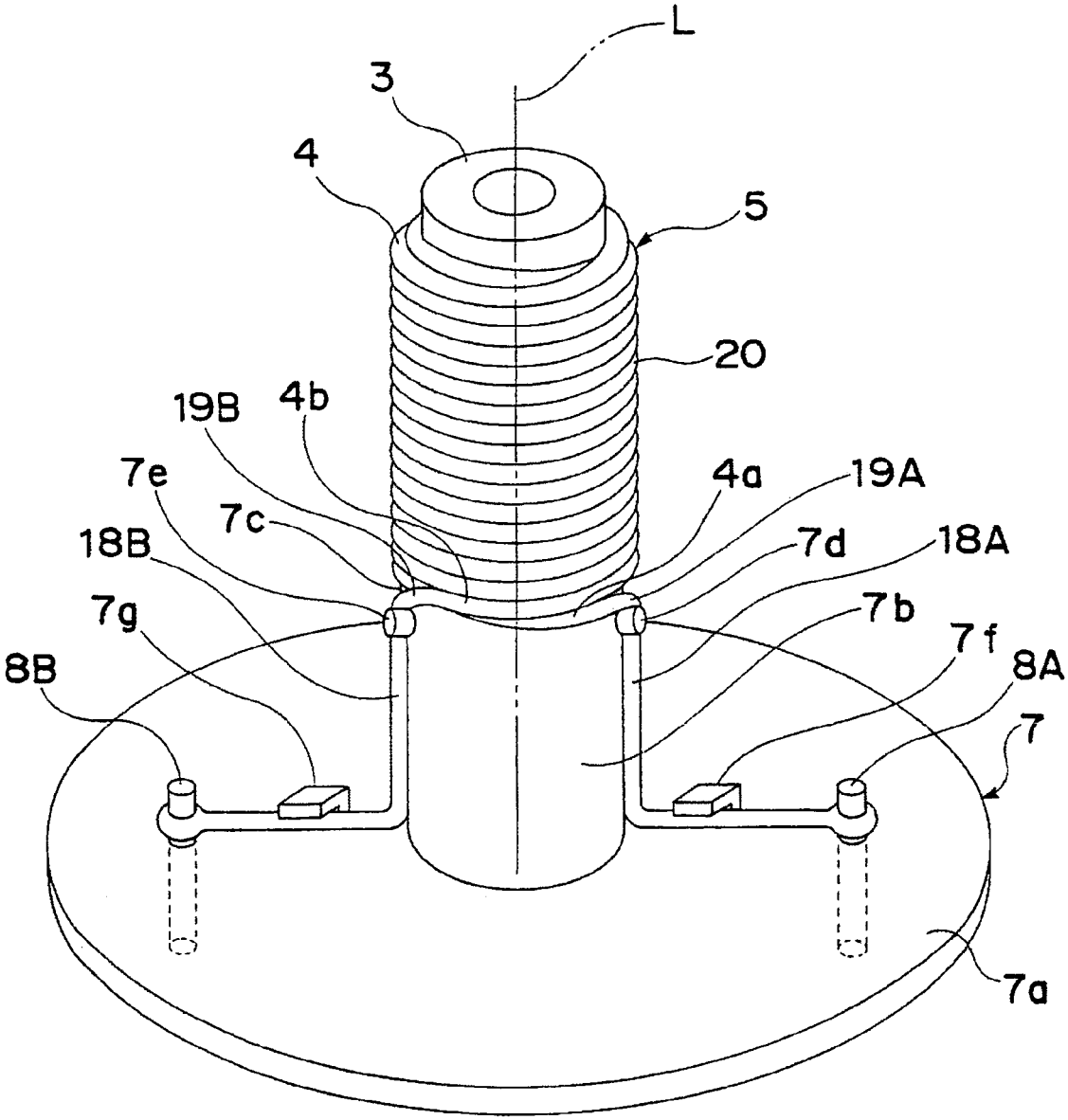
FIG. 2 is an enlarged partial perspective view showing the electrodeless discharge lamp according to the first embodiment of the present invention.
Figure 4:
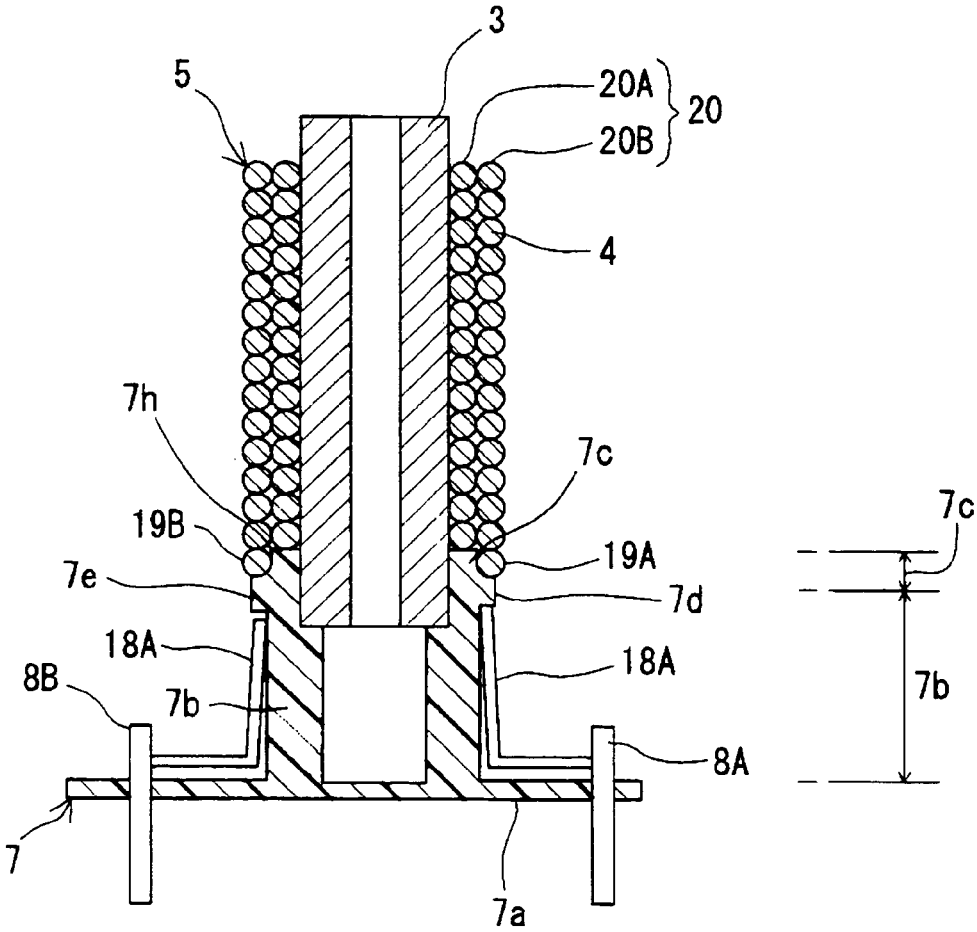
FIG. 4 is a sectional view of the induction coil 5, the magnetic core 3, and the fixation member 7 according to the first embodiment of the present invention.

Further referring FIGS. 2 and 4, the winding wire 4 of the winding portion 20 is begun to be wound around the magnetic core 3 from the proximal end side of the magnetic core 3 (on the side close to the fixation member 7). Further, the winding wire 4 is wound around the magnetic core 3 from the proximal end side of the magnetic core 3 toward a tip side of the magnetic core 3 (on a side away from the fixation member 7). Furthermore, at the tip side of the magnetic core 3, the winding direction of the winding wire 4 is returned so that the winding wire 4 is wound around the magnetic core 3 from the tip side to the proximal end side of the magnetic core 3. Since the winding wire 4 is wound as described above, the winding portion 20 has a first winding wire layer (lower layer) 20A making direct contact with an outer circumferential surface of the magnetic core 3 and a second winding wire layer (upper layer) 20B wound over the first winding wire layer 20A.

The winding wire 4 constituting a lower end of the second winding wire layer 20B is hooked at the hooking projection 7*e* formed on the fixation member 7 so as to be bent. Thus, the extension direction of the winding wire 4 is changed from the direction intersecting with the axial line L to the direction along the axial line L (to form a bent portion 19B). The winding wire 4 extending from the hooking projection 7*e* further extends in the direction along the elongation portion 7*b* away from the magnetic core 3 (to form a straight portion 18B). Further, the winding wire 4 is bent at the joint portion of a lower end of the elongation portion 7*b* and the base plate portion 7*a* and extends along the base plate portion 7*a* toward the terminal 8B via the hook 7*g*. The other end of the winding wire 4 is wound around the terminal 8B and soldered thereto.

The winding wire 4 on the elongation portion 7*b* is formed of the straight portions 18A and 18B which do not disturb the electromagnetic field generated by the induction coil 5. Thus, the power of the electromagnetic field by the induction coil 5 is supplied efficiently to the bulb 1.

The winding portion 20 has the two-layer structure because of the following reason. If the winding portion 20 has an odd number of winding wire layers and the winding wire 4 is wound around the magnetic core 3 according to the method described above, a winding end of the winding wire 4 is positioned in the vicinity of the tip of the magnetic core 3. In other words, the winding end of the winding wire 4 is positioned away from the fixation member 7. Thus, it is necessary to run the winding end portion of the winding wire 3 to the terminal 8B over a long distance along the surface of the winding portion 20. For such arrangement, it is necessary to acutely bend and fold back the winding wire 4 in the vicinity of the tip of the magnetic core 3. As a result, the insulating coating 11 on the winding wire 4 is elongated and becomes extremely thin at some portions. At the bent portion where the insulating coating 11 has become thin, there is a very high possibility that dielectric breakdown occurs between the magnetic core 3 and the winding wire 4, and the insulation reliability is lowered. For preventing the lowering of the reliability, it is necessary that the number of the layers of the winding portion 20 is even number so that both the winding start portion 4*a* and winding end portion 4*b* is disposed on the proximal end side of the magnetic core 3, that is, in the vicinity of the fixation member 7. In other words, in the case that the number of the layers of the winding portion 20 is even number, both the winding start portion 4*a* and the winding end portion 4*b* of the winding wire 4 are disposed in the vicinity of the fixation member 7. Thus by setting the number of the layers even number, any bent portion of the winding wire 4 where the insulating coating 11 becomes extremely thin is not required, and the insulation reliability is improved.

Then, the insulation between adjacent portions of the winding wires 4 constituting the induction coil 5 will be described below.

The present inventors studied a PFA coating having a minimum thickness of 0.07 mm as the insulating coating 11. The driving frequency of the drive circuit 12 was approximately 500 kHz, the number of turns of the winding portion 20 was 70, and a starting voltage which, i.e., a voltage between ends of the induction coil 5 at the time of lamp starting was 7.5 kV maximum. Further, the dielectric strength voltage of the above-mentioned PFA coating was approximately 15 kV.

The insulation between the first and second winding wire layers 20A and 20B is achieved by the insulating coating 11 made of PFA with the above-mentioned dielectric strength voltage. The maximum voltage generated between the winding wires 4 of the two winding wire layers 20A and 20B is 7.5 kV. On the other hand, the dielectric strength voltage between the first and second winding wire layers 20A and 20B is 30 kV obtained by the addition of the dielectric strength voltage 15 kV of the insulating coating 11 of the winding wire 4 of the first layer 20A and the dielectric strength voltage 15 kV of the insulating coating 11 of the winding wire 4 of the second layer 20A. Accordingly, the dielectric strength voltage between the winding wires of the first and second layers (30 kV) is sufficiently higher than the maximum voltage generated between the winding wires 4 of the winding wire layers 20A and 20B (7.5 kV).

The dielectric strength voltage has been set at the above-mentioned sufficiently high value because of the following reason. The insulating coating 11 of the winding wire 4 is deteriorated owing to high temperatures during the life of the lamp, thereby lowering the dielectric strength voltage. A durability or life time of insulation was studied by an accelerated thermal test on the assumption that the maximum temperature of the winding wire 4 of the induction coil 5 was 220° C. As a result, the half-value time period of the dielectric strength voltage of the coating was approximately 35,000 hours. On the other hand, the design life of the lamp was 30,000 hours. For securing the insulation life time of 35,000 hours, the initial dielectric strength voltage required for the insulating coating is 15 kV which is the double of 7.5 kV.

However, since dielectric breakdown surely results in that the lamp can not be lightened, it is preferable that the dielectric strength voltage is the double of the maximum voltage between the winding wires 4 in consideration of a safety factor.

Then, the insulation between the magnetic core 3 and the winding wire 4 will be described below.

Figure 5:
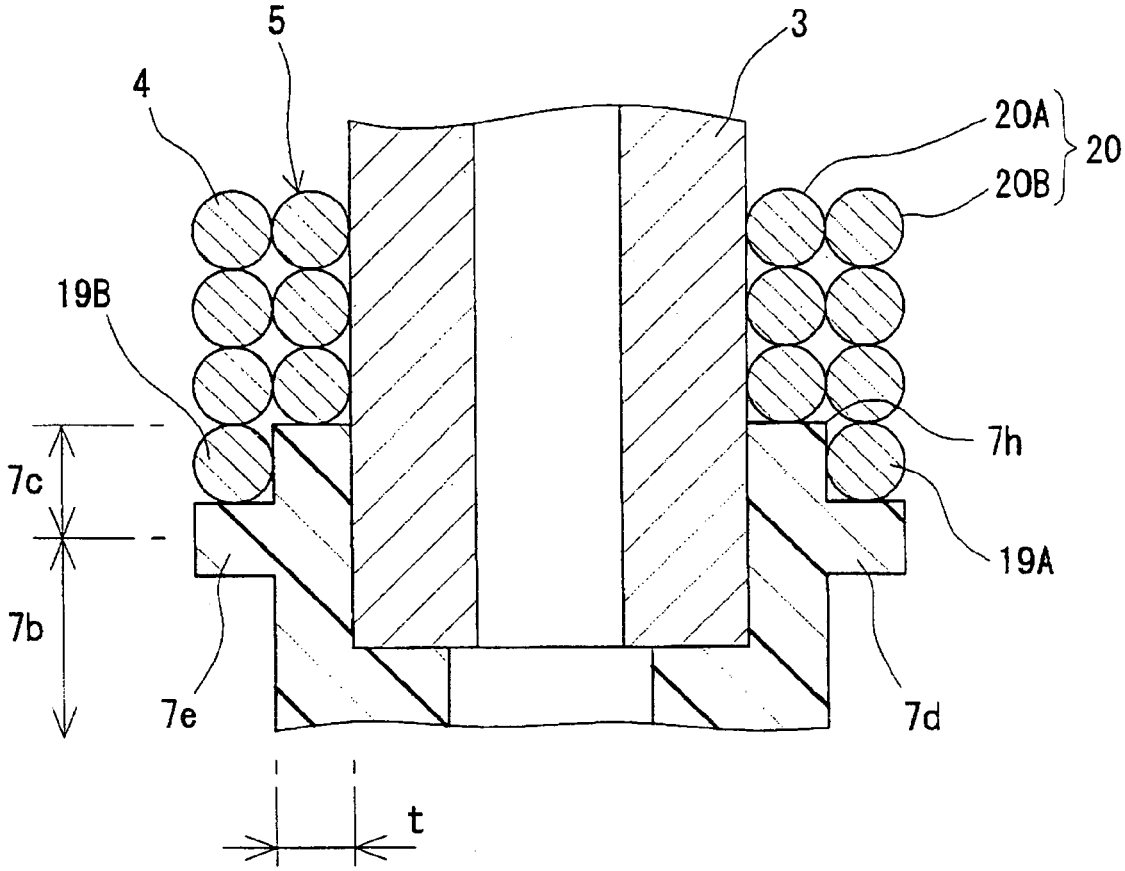
FIG. 5 is an enlarged partial view of FIG. 4, showing a configuration for fixing the magnetic core 3 according to the first embodiment of the present invention.

With reference to FIGS. 4 and 5, the fixation member 7 has the elongation portion 7*b* and the holding portion 7*c* being integrated therewith as described above. Further, at the boundary between the elongation portion 7*b* and the holding portion 7*c*, the hooking projections 7*d* and 7*e* are arranged. The holding portion 7*c* prevents dielectric breakdown between the magnetic core 3 and the bent portions 19A and 19B of the winding wire 4. It was confirmed by the experiments conducted by the present inventors that the bent portions 19A and 19B of the winding wire 4 have a high probability of dielectric breakdown occurrence because the insulating coating 11 becomes thinnest at these portions. Due to arranging the holding portion 7*c* made of insulator between the magnetic core 3 and the bent portions 19A and 19B, insulation between the magnetic core 3 and the winding wire 4 are achieved. Thus, for securely disposing the holding portion 7*c* between the magnetic core 3 and the bent portions 19A and 19B in order to prevent the dielectric breakdown at the bent portions 19A and 19B, it is preferable that the hooking projections 7*d* and 7*e* should be disposed away from the boundary between the holding portion 7*c* and the magnetic core 3 toward the elongation portion 7*b* by a distance equal to or more than the diameter of the winding wire 4 with insulating coating 11.

For comparison, the hooking projections 7*d* and 7*e* were disposed at the boundary position between the holding portion 7*c* and the magnetic core 3, and the winding wire 4 was wound around the magnetic core 3 so that the bent portions 19A and 19B made contact with the magnetic core 3. In this arrangement, when the first winding wire layer 20A of the winding portion 20 contacting with the magnetic core 3 was connected to a high-voltage output terminal 42A of the drive circuit 12 described later, a current leakage to the magnetic core 3 occurred at that same time of as that the electrodeless discharge lamp was activated, and the lamp became unable to be activated. It is conceivable that this is caused by that the insulating coating 11 on the winding wire 4, being made unevenly flat and thin at the bent portions 19A and 19B by the hooking projections 7*d* and 7*e*, is on the magnetic core 3. On the other hand, in the case that the hooking projections 7*d* and 7*e* were disposed away from the above-mentioned boundary by the distance equal to the diameter of the winding wire 4, when the first winding wire layer 20A of the winding portion 20 was connected to the high-voltage side of the drive circuit 12, the electrodeless discharge lamp does not become unable to be activated immediately after activation.

When only the prevention of the dielectric breakdown between the winding wire 4 and the magnetic core 3 is considered, such arrangement that the holding portion 7*c* covers the whole surface of the magnetic core 3 can be substituted for the holding portion 7*c*. Such arrangement corresponds to the coil bobbin 302 (FIG. 16) of the prior art. However, such arrangement results in that the outside diameter of the induction coil 5 becomes larger, casing that it is necessary to set the diameter of the cavity 2 at a larger value. It is thus impossible to realize a compact electrodeless discharge lamp. For this reason, it is preferable that the length of the holding portion 7*c*, i.e., the distance from the boundary between the holding portion 7*c* and the magnetic core 3 to the hooking projections 7*d* and 7*e* is not more than the double of the diameter of the winding wire 4. The length of the holding portion 7*c* set at a value not more than the double of the diameter of the winding wire 4 achieves the smaller diameter of the cavity and the wider space of the bulb 1, resulting in that the plasma discharge can be generated more easily.

As described above in detail, it is thus possible to prevent the dielectric breakdown between the magnetic core 3 and the bent portions 19A and 19B of the winding wire 4 and to realize a compact electrodeless discharge lamp, by providing the hooking projections 7*d* and 7*e* at a position away from the boundary between the holding portion 7*c* and the magnetic core 3 toward the elongation portion 7*b* by a distance equal to or more than the diameter of the winding wire 4 and not more than the double of the diameter, that is, by setting the length of the holding portion 7*c* at a value between once and twice of the diameter of the winding wire 4. Typically, the diameter of the winding wire 4 is approximately 0.5 to 1.2 mm, and thus the length of the holding portion 7*c* is set in the range of approximately 0.8 to 2 mm.

In the case that the winding wire 4 was not provided with the insulating coating 11 and the insulation between the winding wire 4 and the magnetic core 3 was secured by providing a bobbin (the coil bobbin 302 in FIG. 16) in the whole region between the magnetic core 3 and the winding wire 4, the thickness of the bobbin was required to be approximately 0.8 mm. Such large thickness of the bobbin is necessary because the viscosity of a resin material when melted is very high, and the resin material does not flow smoothly inside a mold when an attempt is made to decrease the thickness. By providing the insulating coating 11 on the winding wire 4 and by directly winding the winding wire 4 around the magnetic core 3, the diameter of the induction coil 5 can be made smaller by approximately 1.5 mm than that in the case that the bobbin is provided.

The holding portion 7*c* also serves as a fixing portion for fixing the magnetic core 3 to the fixation member 7. With reference to FIGS. 4 and 5, the proximal end side of the magnetic core 3 is inserted into the inner circumference of the holding portion 7*c*, thereby the outer circumferential surface of the magnetic core 3 and the inner circumferential surface of the holding portion 7*c* are fixed to each other. As a method for fixing the magnetic core 3, bonding using an adhesive applied to a clearance between the magnetic core 3 and the holding portion 7*c* can be adopted. Such adhesive includes epoxy-based and silicon-based adhesives that are excellent in thermal resistance. As a result of experiments conducted by the present inventors, it was confirmed that a sufficient fixation strength was obtained by the bonding using the above-mentioned adhesives, because the temperature of the fixing portion for fixing the magnetic core 3 to the holding portion 7*c* was lower than the temperature of the winding portion 20 by 15 to 20° C., and no large force was applied to the induction coil 5 after the assembly of the lamp.

Figure 7:
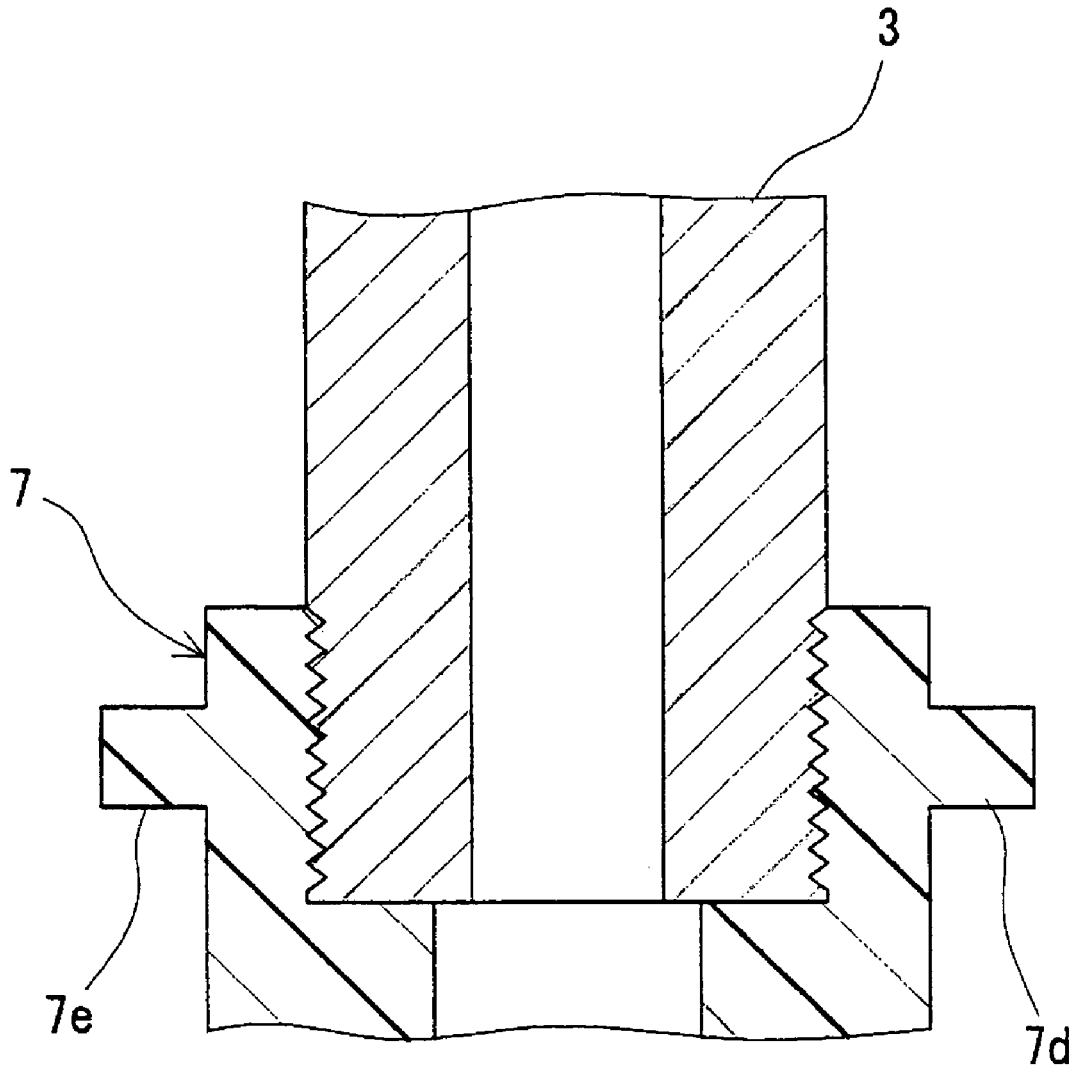
FIG. 7 is an enlarged partial sectional view of other example of a holding portion 7*c* according to the first embodiment of the present invention.

As other fixing method, a fixing method using a modified resin molding as described below is preferable. First, only the portion of the magnetic core 3 making contact with the holding portion 7*c* is machined so as to have a rough surface after the magnetic core 3 is fabricated. Then, the machined magnetic core 3 is disposed at a predetermined position (corresponding to the inside of the holding portion 7*c*) of a mold for molding the fixation member 7. Next, the resin for forming the fixation member 7 is melted and poured into the metal mold so as to be molded. As a result, as shown in FIG. 7, the resin flows into the gaps on the rough surface of the magnetic core 3, and the magnetic core 3 is engaged with the resin of the fixation member 7. This processing can realize a structure for fixing the magnetic core 3 at fixation strength higher than that of bonding.

Figure 8:
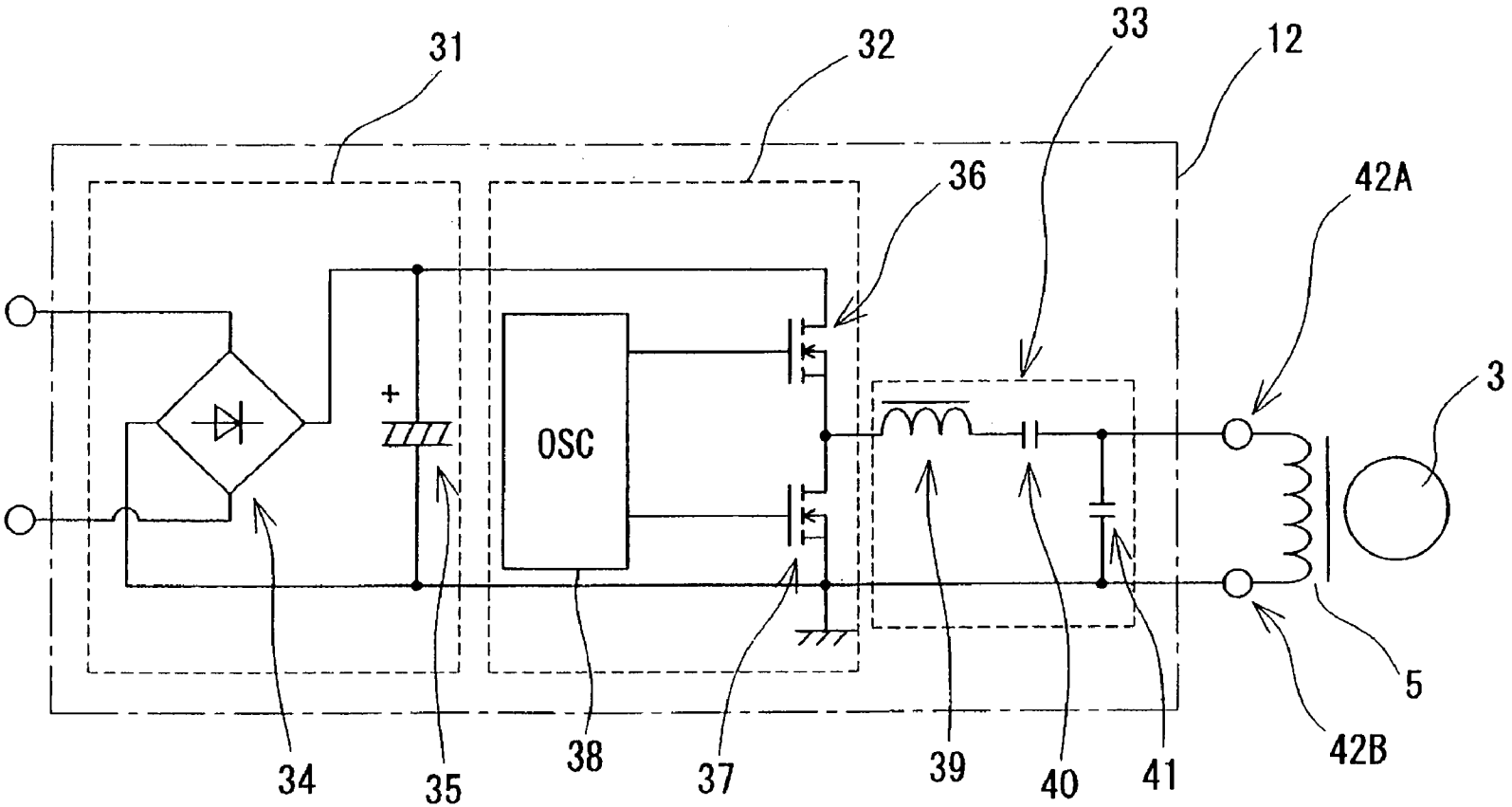
FIG. 8 is a circuit diagram of a drive circuit 12 according to the first embodiment of the present invention.

Next, the drive circuit 12 will be described below referring to FIG. 8. The configuration of the drive circuit 12 shown in FIG. 8 is the most common example. The drive circuit 12 generally comprises three sections, i.e., a DC power supply 31, an inverter circuit 32 and a matching circuit 33. The induction coil 5 is electrically connected to the output portion of the matching circuit 33. The DC power supply 31 comprises a rectifying device 34 for rectifying a sinusoidal alternating current supplied from a commercial power source and a capacitor 35 for smoothing a rectified sinusoidal current. The inverter circuit 32 comprises two switching devices 36 and 37 and an oscillator circuit 38 for controlling the switching devices 36 and 37. The matching circuit 33 comprises multiple passive devices 39, 40 and 41. In the inverter circuit 32, the DC power generated by the DC power supply 31 is converted into a high-frequency alternating current having a desired frequency by the switching devices 36 and 37 that turn on and off alternately. The high-frequency AC power generated in the inverter circuit 32 is supplied to the induction coil 5 via the matching circuit 33, thereby a discharge plasma is generated in the discharge space inside the bulb 1. The matching circuit 33 carries out impedance matching so that the high-frequency AC power is supplied efficiently to the induction coil 5. As understood from FIG. 8, one of the output terminals 42A and 42B of the matching circuit 33 is a high-voltage output terminal (first output terminal) 42A, and the other is a low-voltage output terminal (second output terminal) 42B having a ground potential. These output terminals 42A and 42B are electrically connected to the induction coil 5.

The design of the insulating coating differs depending on which of the two terminals 8A and 8B of the induction coil 5 is connected to which of the output terminals 42A and 42B (hereafter referred to as the polarity of the induction coil 5) as detailed below. The terminal 8A is connected to the winding start portion 4*a* of the winding wire 4 constituting the induction coil 5 as described above. In other words, the terminal 8A is connected to the side of the first winding wire layer 20A of the winding portion 20. On the other hand, the terminal 8B is connected to the winding end portion 4*b* of the winding wire 4. In other words, the terminal 8B is connected to the side of the second winding wire layer 20B.

First, regarding the insulation between the winding wires of the first and second winding wire layers 20A and 20B and the insulation between the adjacent portions of the winding wires 4, the thickness of the insulating coating 11 can be determined on the basis of only the above-mentioned logic, regardless of whether which of the terminals 8A and 8B is connected to which of the output terminals 42A and 42B.

However, regarding the insulation between the magnetic core 3 and the winding wire 4, the required thickness of the insulating coating 11 differs depending on the polarity of the induction coil 5. More specifically, the insulation between the first winding wire layer 20A of the induction coil 5 and the magnetic core 3 is achieved only by the insulating coating 11 on the winding wire 4. On the other hand, the insulation between the second winding wire layer 20B and the magnetic core 3 is achieved as the addition of the insulation effect owing to the distance between the magnetic core 3 and the winding wire layer 20B obtained by the interposition of the winding 4 constituting the first winding wire layer 20A between the magnetic core 3 and the winding wire layer 20B and the insulation effect owing to the insulating coating 11. This means that once the insulation between the first winding wire layer 20A and the magnetic core 3 is secured, the insulation between the second winding wire layer 20B and the magnetic core 3 is also obtained securely. Thus, in the case that the winding start portion 4*a* (the terminal 8A) of the winding wire 4 constituting the induction coil 5 is connected to the low-voltage output terminal 42B, the thickness of the insulating coating 11 can be designed on the basis of only the above-mentioned logic. On the other hand, in the case that the terminal 8A is connected to the high-voltage output terminal 42A, it is necessary to further increase the thickness of the insulating coating 11 in consideration of the high voltage generated between the magnetic core 3 and the winding wire 4.

For the compact induction coil 5, it is preferable that the insulating coating 11 is as thin as possible. Thus, it is preferable that the winding start portion 4*a* (the terminal 8A) of the winding wire 4 constituting the induction coil 5 is connected to the low-voltage output terminal 42B of the drive circuit 12 and that the winding end portion 4*b* (the terminal 8B) is connected to the high-voltage output terminal 42A because the thickness of the insulating coating 11 can be set at a small value. However, even in the case that the winding end portion 4*b* (the terminal 8B) is connected to the low-voltage output terminal 42B of the drive circuit 12 and that the winding start portion 4*a* (the terminal 8A) is connected to the high-voltage output terminal 42A, it is possible to obtain insulation to the extent that the lamp can be practically used, provided that the winding wire 4 is manufactured carefully so that the insulating coating 11 is not unevenly flattened or scratched.

Then, with reference to FIGS. 4 and 5, the polarity of the induction coil 5 and a step "t" between an outside diameter of the holding portion 7*c* and an outside diameter of the magnetic core 3 will be described below.

The insulating coating 11 is apt to be scratched particularly at the boundary between the holding portion 7*c* and the magnetic core 3 owing to the friction between the corner portion 7*h* of the holding portion 7*c* and the winding wire 4. As described above, scratches on the insulating coating 11 cause lowering in reliability because of the dielectric breakdown. For this reason, it is necessary to pay attention to the design of the step "t" between the outside diameters of the holding portion 7*c* and the magnetic core 3.

According to the result of experiments conducted by the inventors, the suitable value of the step "t" depends on the polarity of the induction coil 5. First, in the case that the terminal 8A on the side of the winding start portion 4*a* is connected to the low-voltage output terminal 42B of the drive circuit 12, in other words, in the case that the first winding wire layer 20A making contact with the magnetic core 3 is on the low voltage side, since the voltage difference between the magnetic core 3 and the first winding wire layer 20A is small, the dielectric breakdown hardly occurs even if the step "t" is relatively small. Rather, it is found that it is suitable that the problem of scratches on the insulating coating 11 is avoided by maintaining the step "t" between the second layer of the winding portion 20 and the holding portion 7*c* at a small value. As a result, it is found that the suitable range of the step "t" is between 30% and 110% of the diameter of the winding wire 4, while the outside diameter of the holding portion 7*c* is made larger than the outside diameter of the magnetic core 3. In this range, it is found that no dielectric breakdown occurs between the winding wire 4 and the magnetic core 3.

On the other hand, in the case that the terminal 8A on the side of the winding start portion 4*a* is connected to the high-voltage output terminal 42A of the drive circuit 12, in other words, in the case that the first winding wire layer 20A making contact with the magnetic core 3 is on the high voltage side, the voltage difference between the magnetic core 3 and the first winding wire layer 20A is large. As the result of experiments conducted by the inventors, it is found that, in the case of this polarity, the dielectric breakdown is apt to occur when the step "t" is relatively large. This is because when the step "t2 is large, the winding wire 4 is bent acutely at the boundary between the holding portion 7*c* and the magnetic core 3, and the insulating coating 11 is apt to be unevenly flattened and scratched at this portion. For this reason, in the case that the terminal 8A on the side of the winding start portion 4*a* is connected to the high-voltage output terminal 42A, it is suitable that the step "t" is made smaller than in the case that the terminal 8A is connected to the low-voltage output terminal 42B. The suitable range of the step "t" is between 10% and 30% of the diameter of the coated winding wire 4. By this arrangement, no dielectric breakdown occurred. Further, when the corner portion 7*h* is chamfered into round surface, the insulating coating 11 is hardly scratched, and the insulation reliability can be improved further.

Although the driving frequency of the drive circuit 12 of the first embodiment is approximately 500 kHz, the effect of the present invention is achieved regardless the driving frequency. The effect is particularly significant at the range between 50 kHz and 1 MHz. This is because the materials for the magnetic core 3 suitably used in this frequency band has high conductivity as described above. Further, although the electrodeless discharge lamp according to the first embodiment is a bulb-type fluorescent lamp, the effect of the present invention is not limited to the bulb-type configuration. Furthermore, although the winding wire 4 is connected to the drive circuit 12 via the terminals 8A and 8B in the first embodiment, the winding wire 4 constituting the induction coil 5 may also be connected directly to the drive circuit 12 without using terminals. These points are also applicable to a second embodiment.

Second Embodiment

FIGS. 9 to 12 show an electrodeless discharge lamp according to a second embodiment of the present invention. Since the operation of the electrodeless discharge lamp of the second embodiment is the same as that of the first embodiment, the description thereof is omitted.

This embodiment differs from the first embodiment in that the winding wire 4 of the induction coil 5 has a one-turn winding portion (dummy winding portion 51) at the side of the winding start portion 4*a*. The dummy winding portion 51 is wound around the elongation portion 7*b* at the side of the base plate portion 7*a* of the elongation portion 7*b*. Further, a hooking projection (second bending portion) 7*i* for hooking the dummy winding portion 51 is provided on the elongation portion 7*b*. This hooking projection 7*i* protrudes in the direction perpendicular to the axial line L. The hooking projection 7*i* is disposed so as to be arranged together with the hooking projection 7*d* in the direction of the axial line L. On the side of the winding start portion 4*a*, the dummy winding portion 51 is provided by winding the winding wire 4 extending from the terminal 8A one turn around the elongation portion 7*b*. A trailing end of the dummy winding portion 51 is bent at the hooking projection 7*i*, and the winding wire 4 further extends along the elongation portion 7*b* toward the winding portion 20, thereby forming the straight portion 18A of the winding wire 4. Since the method for winding the winding wire 4 in the winding portion 20 is the same as that in the first embodiment, the description thereof is omitted.

The dummy winding portion 51 is provided in the region of the elongation portion 7*b* the most far away from the magnetic core 3 (not on the side of the straight portion 18A but on the side of the drive circuit 12). For this reason, the dummy winding portion 51 hardly contributes to the inductance of the induction coil 5. In order that the dummy winding portion 51 does not affect the induction coil 5, the length of the straight portion 18A is equal to or more than 10 mm. By provision of the dummy winding portion 51, the winding wire 4 becomes less detached from the hook 7*f* and the hooking projection 7*d*, comparing to the first embodiment where the winding wire 4 is bent at the boundary between the elongation portion 7*b* and the base plate portion 7*a*, is held by only the hook 7*f*, and run along the base plate portion 7*a*. Further, since the trailing end of the dummy winding portion 51 is hooked at the hooking projection 7*i* and bent, the winding wire 4 becomes further less detached from the hook 7*f* and the hooking projection 7*d*. Thus, productivity can be improved by providing the dummy winding portion 51 and the hooking projection 7*i*.

Although the dummy winding portion 51 is provided only on the side of the winding start portion 4*a*, a similar dummy winding portion can also be provided on the side of the winding end portion 4*b*. By such arrangement the winding wire 4 on the side of the winding end portion 4*b* becomes less detached from the hooking projection 7*e* and the hook 7*g*. This arrangement is further preferable in view of productivity.

EXPERIMENT

For verifying the effect of decreasing the outside diameter of the induction coil 5 by the present invention, the present inventors made two kinds of prototype lamps described below and evaluated them.

Figure 16:
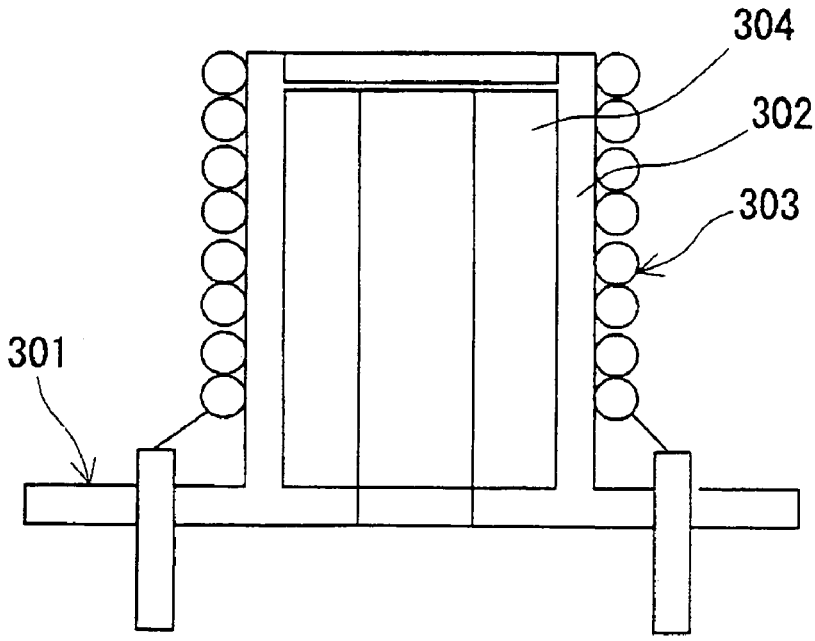
Fig. 16 PRIOR ART
FIG. 16 is a schematic view of the structure of other example of the conventional induction coil.

A prototype electrodeless discharge lamp (comparative example) having a structure shown in FIG. 16 was made. The outside diameter of the magnetic core 304 was 13.6 mm, and the wall thickness of the coil bobbin 302 was 0.8 mm. The induction coil 303 formed by winding a wire with no insulating coating 70 turns so as to form two layers. The maximum outside diameter of the induction coil 303 was 18.4 mm. A bulb having an outside diameter of 60 mm was used and filled with a krypton gas having a pressure of 200 Pa and mercury. The inside diameter of the hollow portion was 19.3 mm.

Figure 9:
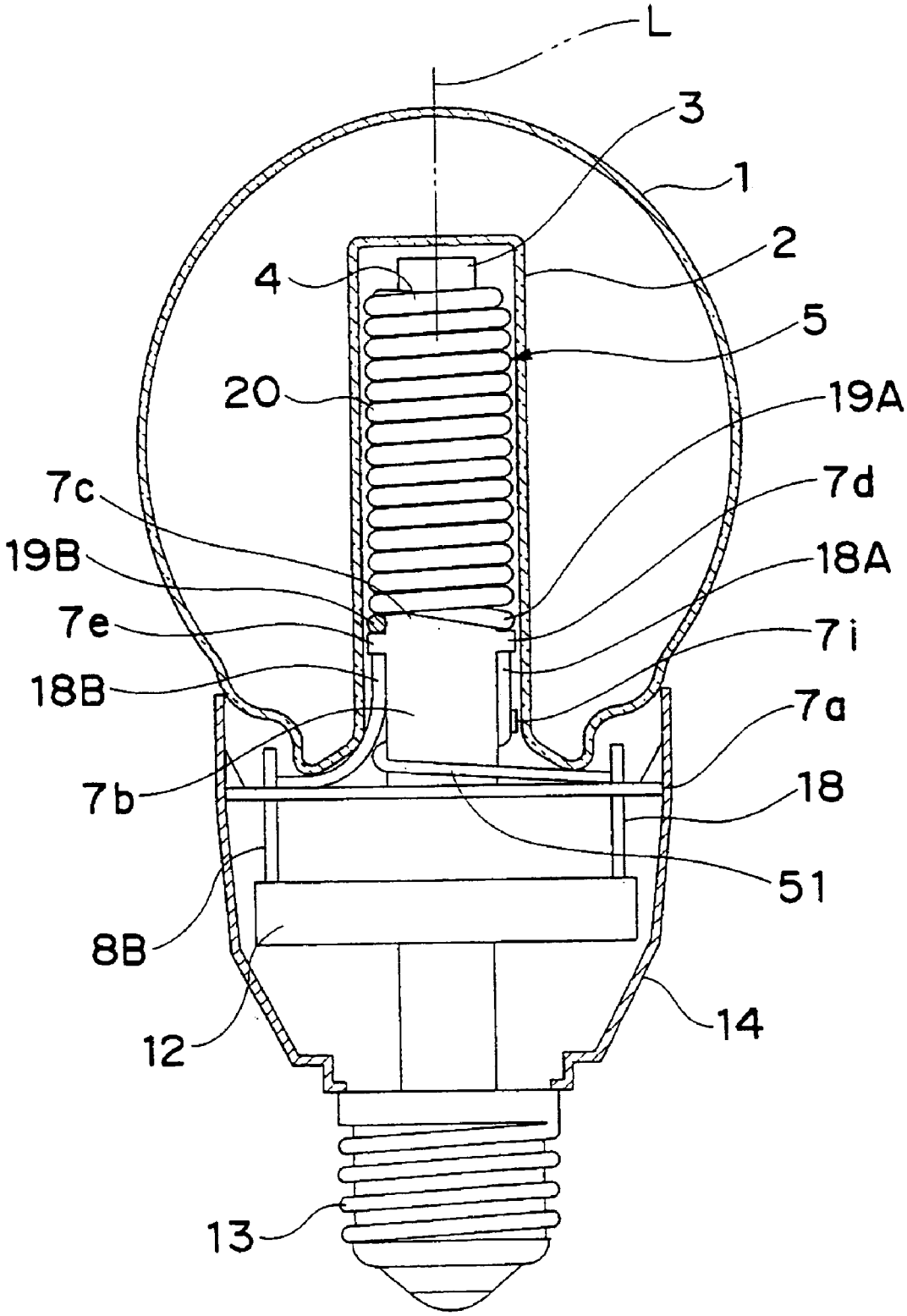
FIG. 9 is a partially sectional front view showing an electrodeless discharge lamp according to a second embodiment of the present invention.
Figure 1:
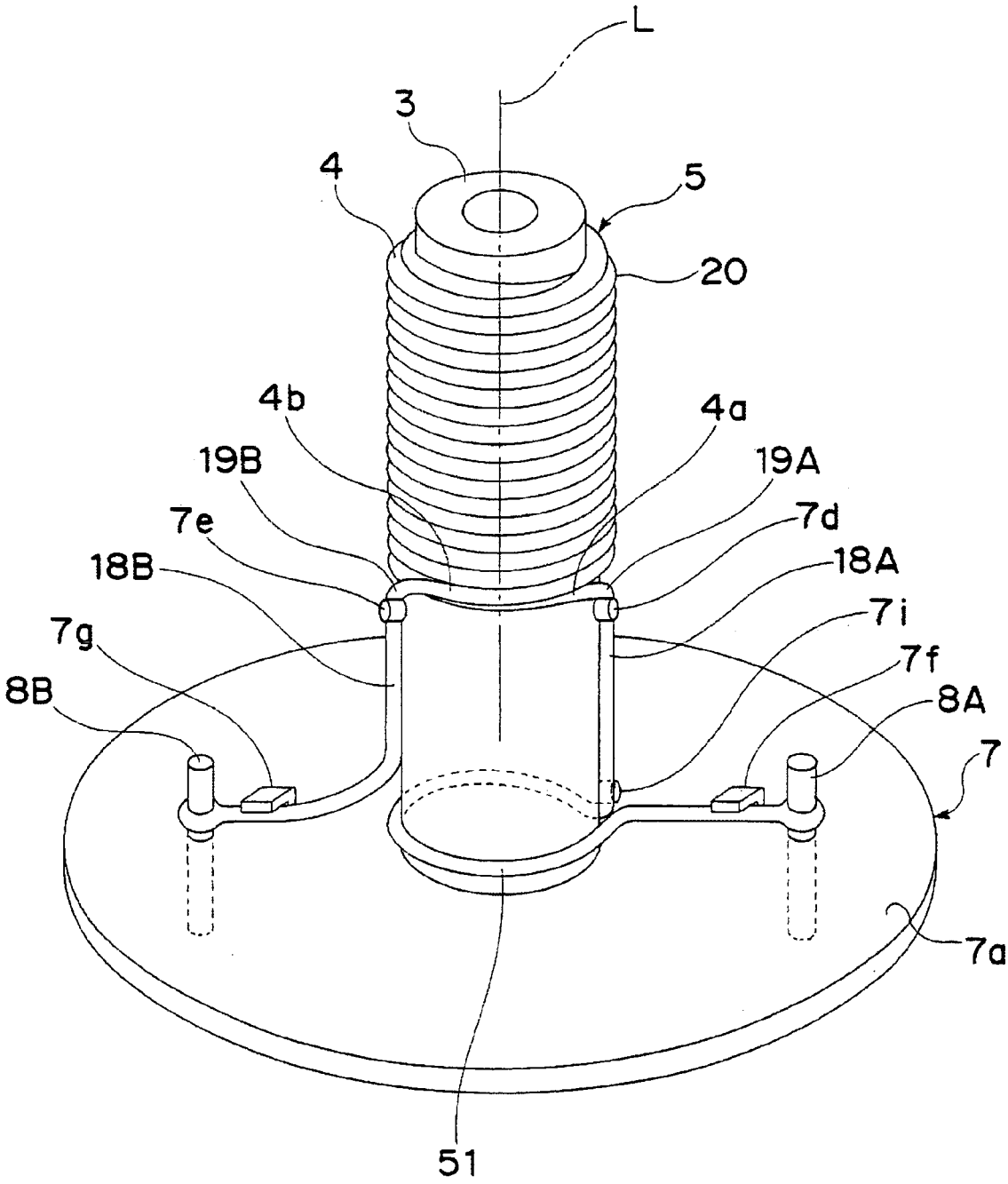
Figure 11:
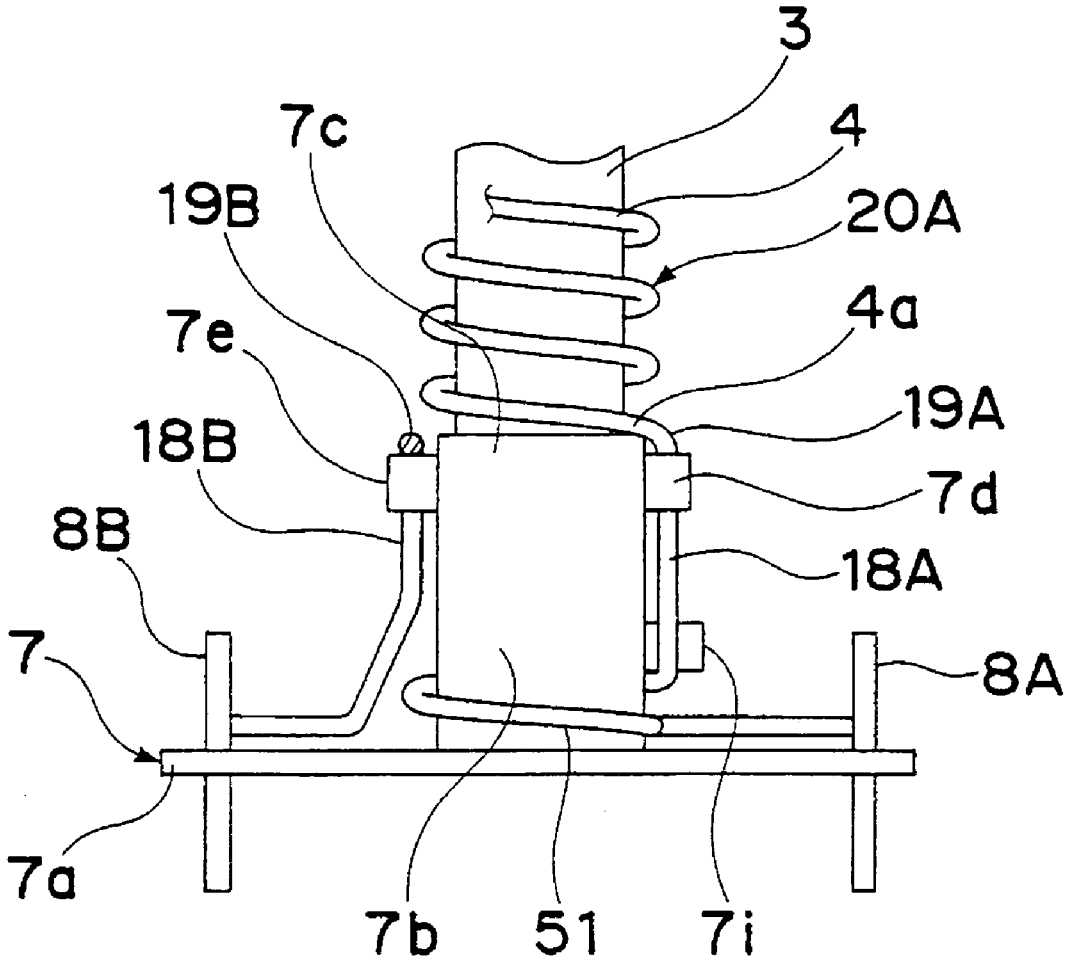
FIG. 11 is a schematic view of an induction coil 5, a magnetic core 3, and a fixation member 7 according to the second embodiment of the present invention.
Figure 12:
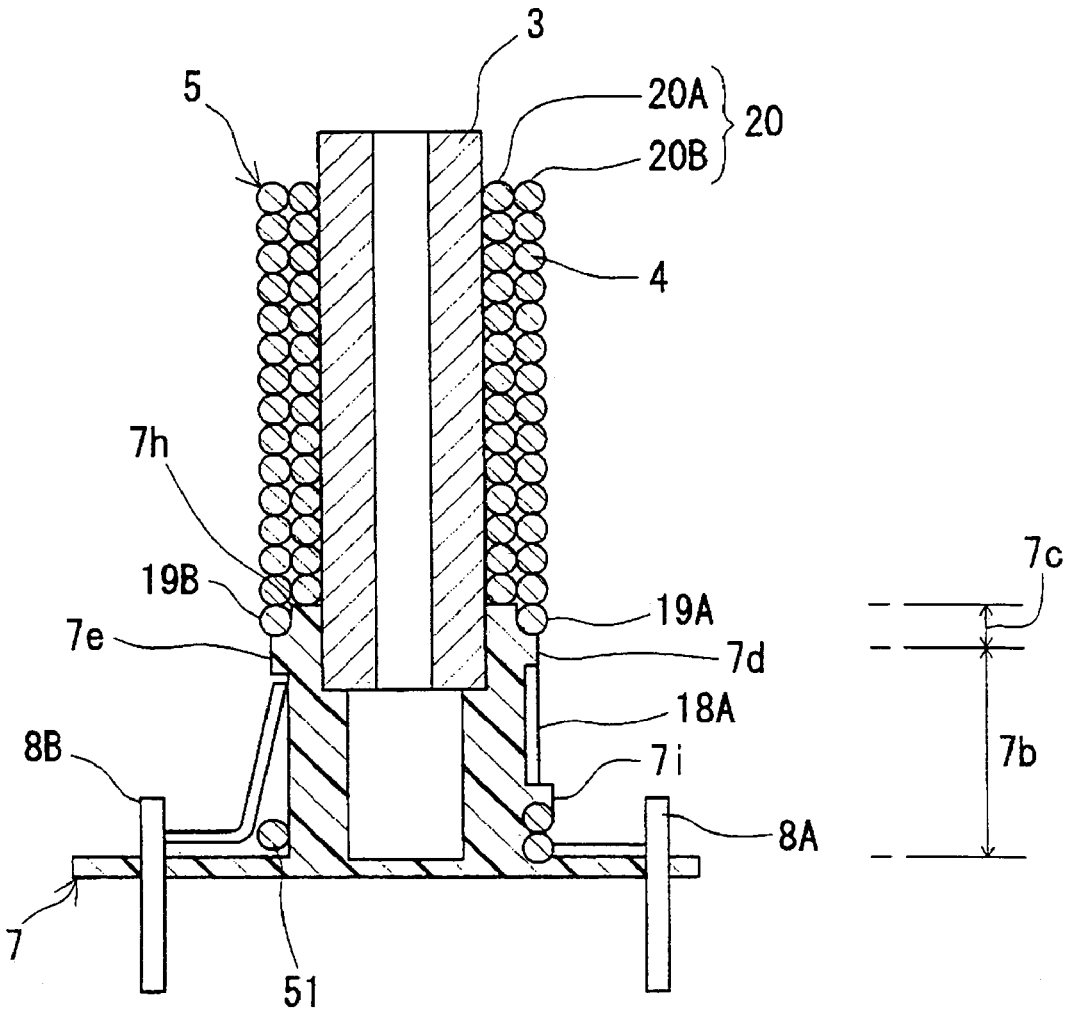
FIG. 12 is a sectional view of the induction coil 5, the magnetic core 3, and the fixation member 7 according to the second embodiment of the present invention.

Further, a prototype electrodeless discharge lamp (experimental example) having a structure shown in FIG. 9 (second embodiment) was made. The number of turns of the winding portion 20 was 70 in two layers as in the comparative example. The winding wire had 1.5 turns at the winding start portion and 1.5 turns at the winding end portion as margins. The outside diameter of the magnetic core 3 was 12.2 mm, and the thickness of the insulating coating 11 was 0.08 mm. The diameter of the winding wire 4 including the insulating coating 11 was 0.7 mm. Further, the terminal 8A was connected to the low-voltage output terminal 42B of the drive circuit 12, and the step "t" was 0.3 mm. As a result, the maximum outside diameter of the induction coil 5 was 15.6 mm. The bulb 1 had same design as that of the comparative example, except that the inside diameter of the cavity 2 was 16.3 mm. Since the inside diameter of the hollow portion of the comparative example was 19.3 mm as described above, the inside diameter of the cavity 2 of the bulb 1 of the experimental example was smaller by 3.0 mm than that of the comparative example. The driving frequency of the drive circuit 12 was approximately 500 kHz in both the comparative and experimental examples.

As a result of the evaluation of the lamps of the comparative and experimental examples, the minimum power required for maintaining a discharge plasma was 7 W in the comparative example and 6 W in the experimental example. This 1 W of difference in the minimum power is mainly caused by the loss owing to the diffusion of electrons in the discharge plasma. In other words, it was found that a very large difference was obtained in the generation of discharge and the easiness of maintaining the discharge by reducing the diameter of the cavity 2 by only 3 mm. As described above, in the present invention, since insulation performance is secured although the winding wire 4 is directly wound around the magnetic core 3, the induction coil 5 and the cavity 2 are reduced in diameter, thereby the discharge plasma can be generated easily and the luminous efficiency of the lamp can be improved.

Figure 13:
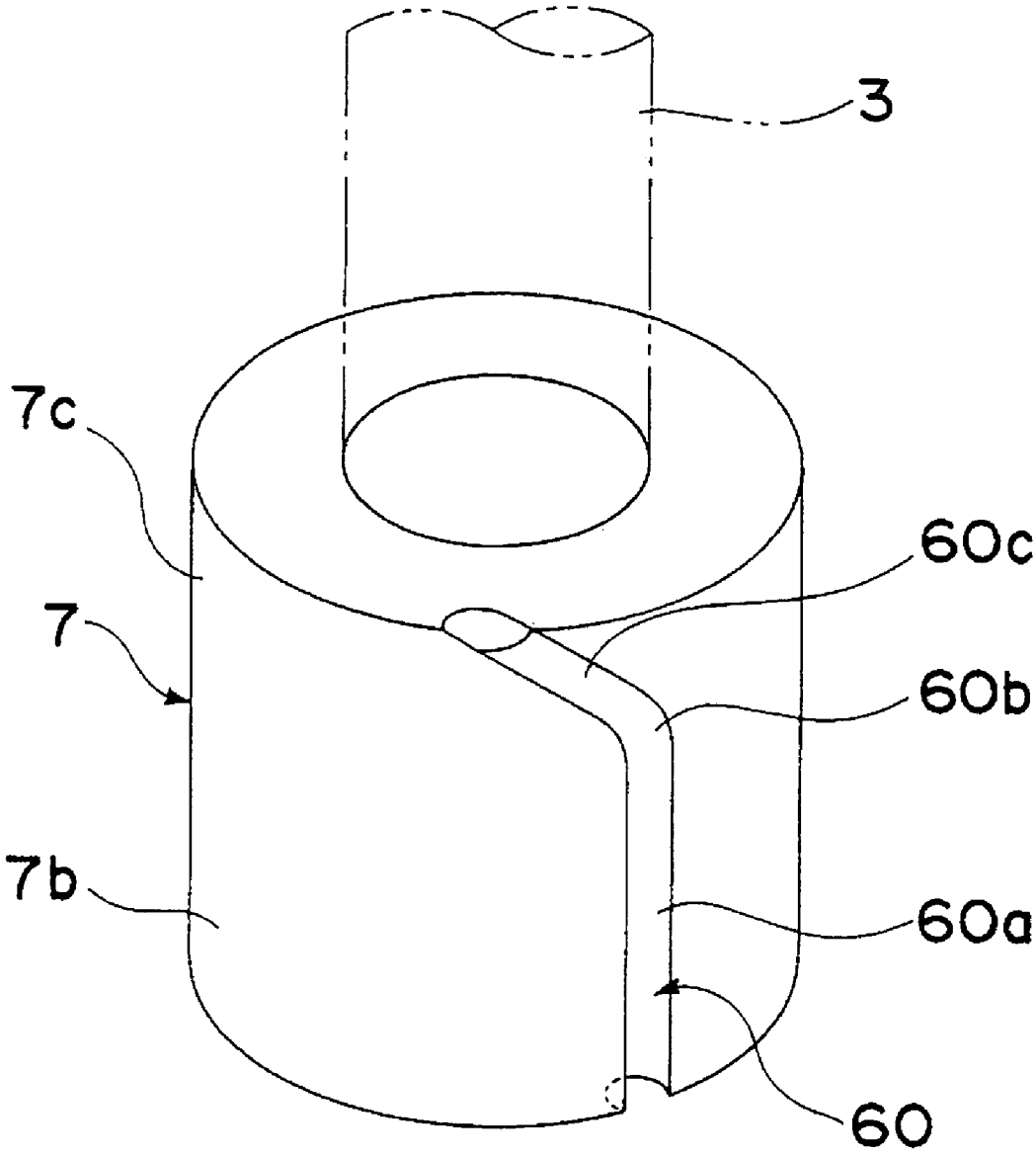
FIG. 13 is a schematic partial perspective view of a modification example of the fixation member.
Figure 14:
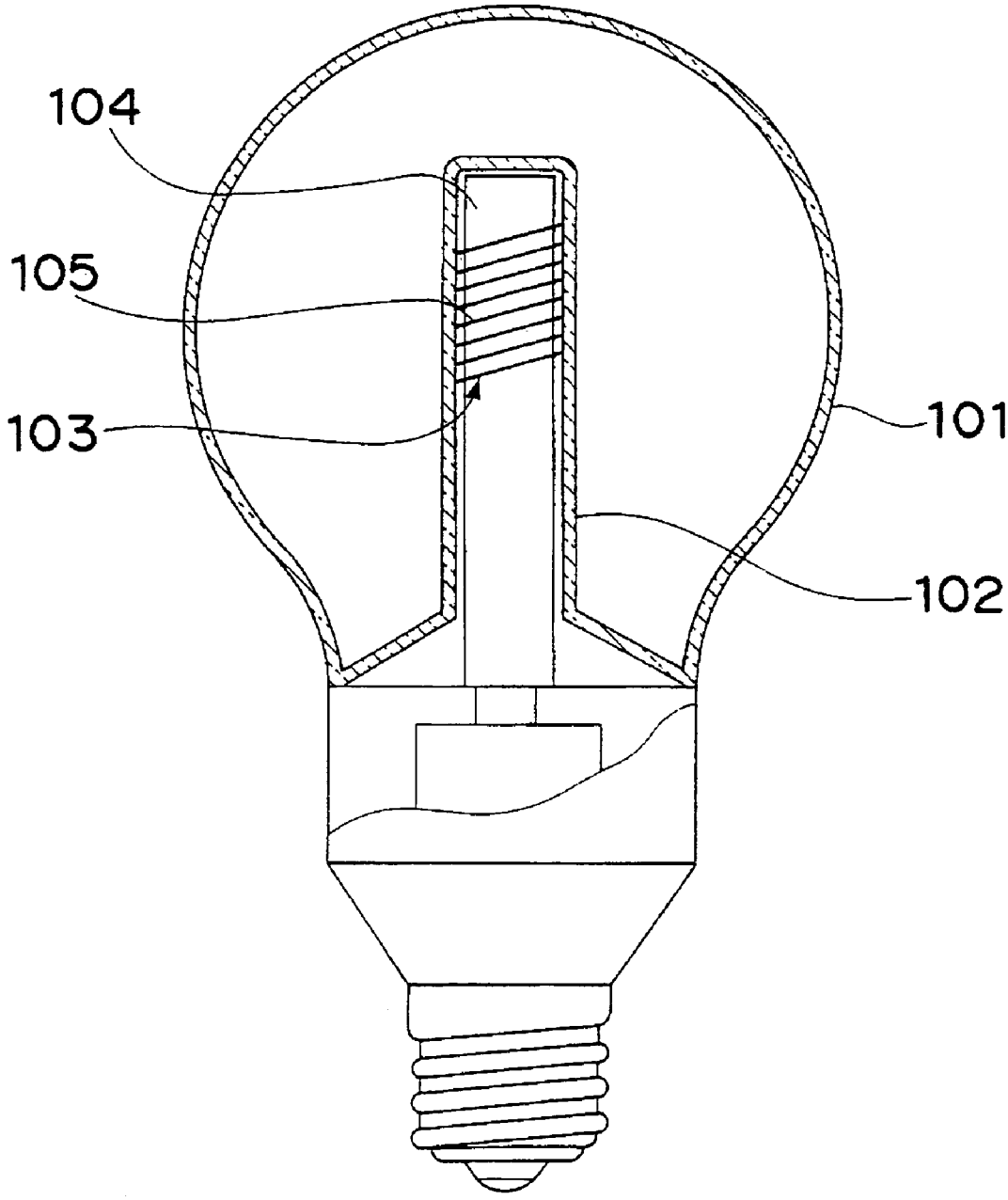
Fig. 14 PRIOR ART
FIG. 14 is a partially sectional front view of the structure of the conventional electrodeless discharge lamp.
Figure 15:
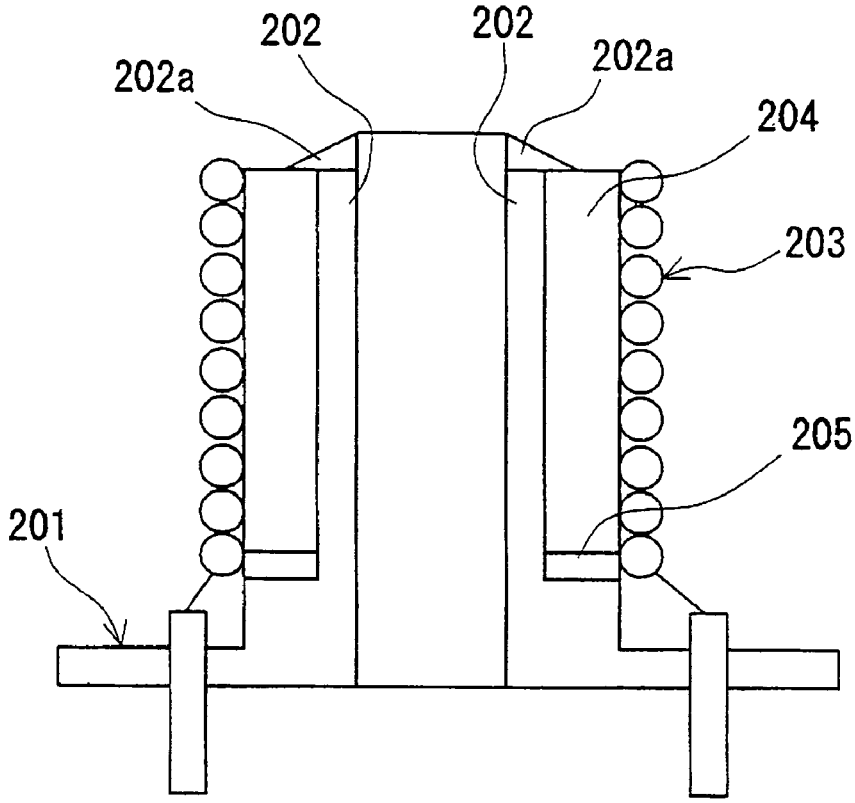
Fig. 15 PRIOR ART
FIG. 15 is a schematic view of the structure of one example of the conventional induction coil.

FIG. 13 shows a modification example in accordance with the present invention. In this modification example, a groove structure 60 for accommodating the winding wire 4 is formed in the range from the elongation portion 7*b* to the holding portion 7*c* of the fixation member 7 as an example of the inflecting portion for inflecting the wiring wire. This groove structure 60 comprises a first straight portion 60*a* for accommodating the straight portion 18A (see FIG. 2) of the winding wire 4 extending in the direction along the axial line L of the magnetic core 3, a bent portion 60*b* being bent from the direction along the axial line L to the direction intersecting with the axial line L at the boundary between the elongation portion 7*b* and the holding portion 7*c*, and a second straight portion 60*c* extending from the bent portion 60*b* to the tip of the holding portion 7*c*. The bent portion 60*b* has a function similar to that of the hooking projection 7*d* according to the first and second embodiments. The winding wire 4 is bent at the bent portion 60*b*.

The present invention is suitably used in the field of electrodeless discharge lamps having a relatively low driving frequency and in the field of lighting apparatuses using such electrodeless discharge lamps.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. An electrodeless discharge lamp comprising:

a bulb filled inside with a discharge gas and having a cavity;

a magnetic core disposed in the cavity;

an induction coil formed by winding a winding wire with an electrically insulating coating around the magnetic core and disposed in the cavity; and a fixation member for fixing the magnetic core, wherein the fixation member has an elongation portion extending in a direction along an axial line of the magnetic core, a holding portion for holding the magnetic core positioned closer to the magnetic core than the elongation portion, and a inflecting portion for inflecting the winding wire positioned away from a boundary between the holding portion and the magnetic core toward the elongation portion by a distance between once and twice of a diameter of the winding wire, and wherein the winding wire of the induction coil has a winding portion wound around the magnetic core via the coating, and straight portions extending toward the magnetic core along the elongation portion.

2. An electrodeless discharge lamp according to claim 1, wherein the inflecting portion is a hook portion or groove structure.

3. An electrodeless discharge lamp according to claim 2, wherein the winding wire of the induction coil has a bent portion at the hook portion or the groove structure.

4. An electrodeless discharge lamp according to claim 1, further comprising a drive circuit with a driving frequency between 50 kHz and 1 MHz for supplying high-frequency power to the induction coil.

5. An electrodeless discharge lamp according to claim 4, wherein the magnetic core is made of Mn—Zn ferrite.

6. An electrodeless discharge lamp according to claim 5, wherein a number of layers of the winding portion of the winding wire is even number.

7. An electrodeless discharge lamp according to claim 5, wherein the winding wire further have a dummy winding portion at a side of the drive circuit with respect to the straight portion.

8. An electrodeless discharge lamp according to claim 7, wherein the elongation portion of the fixation member has a second inflecting portion for inflecting the dummy winding portion.

9. An electrodeless discharge lamp according to claim 4, wherein a number of layers of the winding portion of the winding wire is even number.

10. An electrodeless discharge lamp according to claim 4, wherein the drive circuit has a first output terminal with a first output and a second output terminal with a second output lower than the first output, and wherein the winding portion of the winding wire is connected to the second output terminal of the drive circuit at an end of a winding start portion.

11. An electrodeless discharge lamp according to claim 10, wherein a step portion formed by a contour of the holding portion and a contour of the magnetic core has a size between 30% and 110% of a diameter of the winding wire.

12. An electrodeless discharge lamp according to claim 4, wherein the drive circuit has a first output terminal with a first output and a second output terminal with a second output lower than the first output, and wherein the winding portion of the winding wire is connected to the first output terminal of the drive circuit at an end of a winding start portion.

13. An electrodeless discharge lamp according to claim 12, wherein a step portion formed by a contour of the holding portion and a contour of the magnetic core has a size between 10% and 30% of a diameter of the coated winding wire.

14. An electrodeless discharge lamp according to claim 4, wherein the winding wire further have a dummy winding portion at a side of the drive circuit with respect to the straight portion.

15. An electrodeless discharge lamp according to claim 14, wherein the elongation portion of the fixation member has a second inflecting portion for inflecting the dummy winding portion.

* * * * *